US010759649B2

(12) United States Patent
Haile et al.

(10) Patent No.: US 10,759,649 B2
(45) Date of Patent: Sep. 1, 2020

(54) SYSTEM AND METHOD FOR AUTOMATIC FUELING OF HYDRAULIC FRACTURING AND OTHER OILFIELD EQUIPMENT

(71) Applicants: Luke Haile, Springtown, TX (US); Daniel Thomas Haile, Archer City, TX (US)

(72) Inventors: Luke Haile, Springtown, TX (US); Daniel Thomas Haile, Archer City, TX (US)

(73) Assignee: American Energy Innovations, LLC, Springtown, TX (US)

( * ) Notice: Subject to any disclaimer, the term of this patent is extended or adjusted under 35 U.S.C. 154(b) by 151 days.

(21) Appl. No.: 15/135,761

(22) Filed: Apr. 22, 2016

(65) Prior Publication Data

US 2017/0305736 A1 Oct. 26, 2017

(51) Int. Cl.

| | |
|---|---|
| ***B67D 7/04*** | (2010.01) |
| ***B67D 7/40*** | (2010.01) |
| ***B67D 7/16*** | (2010.01) |
| ***B67D 7/84*** | (2010.01) |
| ***B67D 7/14*** | (2010.01) |

(Continued)

(52) U.S. Cl.

CPC ..... *B67D 7/04* (2013.01); *B67D 7/0401* (2013.01); *B67D 7/145* (2013.01); *B67D 7/16* (2013.01); *B67D 7/3209* (2013.01); *B67D 7/40* (2013.01); *B67D 7/78* (2013.01); *B67D 7/845* (2013.01)

(58) Field of Classification Search

CPC ... B67D 7/04; B67D 7/16; B67D 7/40; B67D 7/0401; B67D 7/145; B67D 7/3209; B67D 7/78; B67D 7/845; E21B 43/26

USPC ..... 141/230, 231

See application file for complete search history.

(56) References Cited

U.S. PATENT DOCUMENTS 1,644,090 A * 10/1927 Sawyer ..... B60P 3/2265 222/145.8
1,993,617 A * 3/1935 Nason ..... B65H 75/4426 242/385.1
2,176,635 A 10/1938 Mattson (Continued)

FOREIGN PATENT DOCUMENTS

CA 2693567 C 10/2010
CA 2789386 A1 8/2011

(Continued)

OTHER PUBLICATIONS www.fracshack.com; "Welcome to Frac ShackTM," "Technology" and "Marketing Materials" pages, 9 pages.

(Continued)

*Primary Examiner* — Timothy L Maust
*Assistant Examiner* — James R Hakomaki
(74) *Attorney, Agent, or Firm* — James E. Walton

(57) ABSTRACT

A system and method for fueling multiple saddle tanks of hydraulic fracturing equipment from a single cart. The cart having multiple retractable fuel lines for providing and obtaining fuel. Each retractable fuel supply line uses a flowmeter, a ball valve, and an electrically actuated valve to provide remote control to a controller based upon a user's selected fueling requirements. An electronic reporting system provides fuel data to operators and users. Fuel data such as fuel tank status, amount of fuel usage over a stage level, a daily level, or job level along with a fill level of the fuel tank.

11 Claims, 9 Drawing Sheets

(51) Int. Cl.
*B67D 7/78* (2010.01)
*B67D 7/32* (2010.01)

(56) References Cited

U.S. PATENT DOCUMENTS 2,516,150 A 7/1950 Samiran
2,573,868 A * 11/1951 Newell ..... B65H 75/4486 137/355.21
2,735,717 A * 2/1956 Harman ..... B64F 1/28 137/355.12
2,769,572 A 11/1956 Harman et al.
3,028,010 A 4/1962 Headrick
3,111,968 A 11/1963 Headrick
3,136,295 A 6/1964 Gramo
3,154,164 A * 10/1964 Shaw ..... B60B 27/0026 180/209
3,422,917 A * 1/1969 Guinot ..... B60K 17/10 180/305
3,455,346 A * 7/1969 Stork ..... F04B 35/06 141/42
3,511,090 A * 5/1970 Ehrenfried ..... G01F 23/18 73/301
3,547,141 A 12/1970 Alexander et al.
3,618,643 A 11/1971 Thomson et al.
3,648,720 A * 3/1972 Kornahrens ..... B64F 1/28 137/351
3,695,485 A * 10/1972 Littlejohn ..... B41F 7/24 222/68
4,029,165 A * 6/1977 Miller ..... B62D 11/20 180/6.48
4,059,134 A 11/1977 Violette
4,063,609 A 12/1977 Kincaid
4,139,019 A 2/1979 Bresie et al.
4,162,473 A * 7/1979 Utasi ..... E21B 21/08 175/40
4,244,522 A 1/1981 Hartwig
4,249,633 A * 2/1981 Dunbar ..... B60G 9/02 180/24.02
4,365,509 A * 12/1982 Cornelis ..... E02F 7/04 73/290 R
4,591,115 A 5/1986 DeCarlo
4,638,842 A 1/1987 Hawley et al.
4,671,329 A 6/1987 Kovacevich, Jr.
4,770,317 A 9/1988 Podgers et al.
4,886,282 A 12/1989 Wilkinson et al.
5,025,827 A 6/1991 Weng
5,027,871 A 7/1991 Guenther
5,211,678 A * 5/1993 Stephenson ..... G01F 23/0023 73/149
5,295,521 A 3/1994 Bedi
5,388,622 A 2/1995 Phillips
5,406,988 A 4/1995 Hopkins
5,417,239 A 5/1995 Ford
5,454,408 A 10/1995 DiBella et al.
5,503,199 A 4/1996 Whitley, II et al.
5,538,051 A 7/1996 Brown et al.
5,573,066 A * 11/1996 Vaillancourt ..... B67D 7/84 169/49
5,609,191 A 3/1997 Topping et al.
5,651,400 A 7/1997 Corts et al.
5,708,424 A 1/1998 Orlando et al.
5,769,109 A 6/1998 Stanton et al.
5,884,675 A 3/1999 Krasnov
5,918,266 A 6/1999 Delaney
5,944,074 A 8/1999 Leahy et al.
5,975,162 A 11/1999 Link, Jr.
D427,021 S 6/2000 Moran
6,152,197 A 11/2000 Gerardot
6,178,990 B1 1/2001 Bellenger et al.
6,206,056 B1 3/2001 Lagache
6,213,515 B1 4/2001 La Terra
6,282,953 B1 * 9/2001 Benjey ..... B60K 15/077 73/1.32
6,382,225 B1 5/2002 Tipton
6,450,217 B2 9/2002 Mutter
6,478,576 B1 11/2002 Bradt et al.
6,564,615 B1 5/2003 Carter
6,598,473 B2 * 7/2003 Atkinson ..... G01F 23/0046 73/290 R
6,637,466 B2 10/2003 Mills, Jr.
6,648,086 B1 11/2003 Schulte
6,651,706 B2 11/2003 Litt
6,697,705 B2 2/2004 Johnson et al.
6,755,225 B1 6/2004 Niedwiecki et al.
6,761,194 B1 7/2004 Blong
6,786,245 B1 9/2004 Eichelberger et al.
6,792,966 B2 9/2004 Harvey
6,907,371 B2 * 6/2005 Klinger ..... B60R 16/0232 702/100
6,945,288 B1 9/2005 Brakefield et al.
7,020,906 B2 4/2006 Cuffari, Jr. et al.
7,063,276 B2 6/2006 Newton
7,106,026 B2 9/2006 Moore
7,308,918 B1 12/2007 Brakefield
7,328,761 B1 2/2008 Tyler
7,353,808 B2 4/2008 Kakoo
7,415,995 B2 8/2008 Plummer et al.
7,441,569 B2 10/2008 Leese
7,458,543 B2 12/2008 Cutler et al.
7,568,507 B2 8/2009 Farese et al.
7,602,143 B2 10/2009 Capizzo
7,628,182 B2 12/2009 Poulter et al.
7,762,363 B1 7/2010 Hirschfeld
7,938,151 B2 * 5/2011 Hockner ..... B60P 3/228 141/18
8,109,300 B2 2/2012 Brakefield et al.
8,245,889 B1 8/2012 Starns
8,327,963 B1 12/2012 Faulkingham
8,393,360 B2 3/2013 Brakefield et al.
8,459,585 B1 6/2013 Elder
8,671,998 B2 3/2014 Lohmann
8,731,725 B2 5/2014 Trottier et al.
9,041,548 B2 * 5/2015 Portocalis ..... B64F 1/28 340/870.02
9,346,662 B2 5/2016 Van Vliet et al.
9,371,831 B2 6/2016 Moffitt, Jr.
9,586,805 B1 * 3/2017 Shock ..... B67D 7/40
9,656,833 B2 * 5/2017 Bauck ..... B65H 75/4486
9,939,305 B2 * 4/2018 Tetil ..... G01F 23/0038
2003/0098017 A1 5/2003 Williams, Sr.
2003/0111129 A1 6/2003 Mill, Jr.
2003/0210152 A1 * 11/2003 Cothern ..... B67D 7/3218 340/605
2004/0093942 A1 * 5/2004 Brun ..... G01F 23/18 73/301
2004/0187950 A1 9/2004 Cohen et al.
2005/0199312 A1 9/2005 Wiens
2006/0086411 A1 4/2006 Luca
2006/0118201 A1 6/2006 Li et al.
2006/0196541 A1 9/2006 Gerken et al.
2006/0266430 A1 11/2006 Luca
2007/0079891 A1 4/2007 Farese et al.
2007/0084283 A1 * 4/2007 Carlson ..... G01F 1/007 73/290 V
2007/0164031 A1 7/2007 Holz
2007/0181212 A1 8/2007 Fell
2007/0189906 A1 * 8/2007 Palvolgyi ..... B60K 15/077 417/36
2008/0165001 A1 * 7/2008 Drake ..... G08B 29/24 340/550
2008/0223660 A1 9/2008 Williams et al.
2008/0295586 A1 * 12/2008 Fosseen ..... G07C 5/008 73/114.14
2009/0277018 A1 11/2009 Arena
2010/0089486 A1 4/2010 Koeninger et al.
2010/0108179 A1 5/2010 Emerson, Jr.
2011/0048572 A1 3/2011 Batson et al.
2011/0197988 A1 8/2011 Van Vilet et al.
2011/0297271 A1 12/2011 Haak
2012/0221152 A1 8/2012 Portocalis et al.
2013/0015199 A1 1/2013 Tavolazzi

(56) References Cited

U.S. PATENT DOCUMENTS

| | | | | |
|---|---|---|---|---|
| 2013/0092851 | A1* | 4/2013 | Sakiya | G01F 23/18 250/577 |
| 2013/0112313 | A1 | 5/2013 | Donnelly et al. | |
| 2014/0174599 | A1 | 6/2014 | Porcile et al. | |
| 2014/0223992 | A1* | 8/2014 | Harper | G01F 23/30 73/23.31 |
| 2014/0266650 | A1* | 9/2014 | Newhouse | G01F 23/0061 340/425.5 |
| 2015/0261227 | A1 | 9/2015 | Wiersma | |
| 2015/0285669 | A1* | 10/2015 | Manabe | G01F 23/38 73/311 |
| 2015/0352947 | A1* | 12/2015 | Hubschman | B60K 15/0406 340/450.2 |
| 2016/0167806 | A1* | 6/2016 | Rice | B64F 1/28 141/231 |
| 2016/0244314 | A1 | 8/2016 | Van Vliet et al. | |
| 2016/0362195 | A1 | 12/2016 | Wilkinson et al. | |

FOREIGN PATENT DOCUMENTS

| | | | | |
|---|---|---|---|---|
| DE | 4226326 | A1 | 2/1994 | |
| EP | 1816107 | A1 * | 8/2007 | C02F 1/008 |
| WO | 01/77006 | A1 | 10/2001 | |
| WO | 2006/005686 | A1 | 1/2006 | |
| WO | 2008/083830 | A2 | 7/2008 | |
| WO | 2009/026607 | A1 | 3/2009 | |

OTHER PUBLICATIONS www.afdpetroleum.com; "Onsite Refueling" page, 5 pages.

International Search Report and Written Opinion of the International Searching Authority dated Sep. 29, 2017 from counterpart International Application No. PCT/US2017/29173.

International Search Report and Written Opinion of the Internatinal Searching Authority dated Jun. 14, 2018 from counterpart International Application No. PCT/US2017/29173.

* cited by examiner

SYSTEM AND METHOD FOR AUTOMATIC FUELING OF HYDRAULIC FRACTURING AND OTHER OILFIELD EQUIPMENT

BACKGROUND

1. Field of the Invention

The present invention relates generally to fueling systems for hydraulic fracturing equipment, and more specifically to a system and method for automatically fueling equipment and reporting important information in a real time for fracing hydrocarbon wells.

2. Description of Related Art

Fracturing of hydrocarbon wells requires great amounts of pressure. Diesel, natural gas, and or a combination of those driven pumps are utilized in order to generate pressures sufficient to fracture shale deposits. This equipment is located remotely and require refueling several times during a frac job. Conventional systems for fueling hydraulic fracturing equipment use trucks and pump fuel into saddle tanks from the trucks as required to keep the saddle tanks full. Alternative conventional systems bypass the saddle tanks of the hydraulic fracturing equipment and provide a pressurized fuel line and return line for each piece of equipment. Conventionally data is monitored on a per site basis typically relayed from the single sale pump to a user, therefore no one knows how much fuel each piece of equipment is using in relation to the rest of the fleet. Conventional systems and methods for fueling hydraulic fracturing equipment have disadvantages. First, stopping the frac to refill saddle tanks cost time and money. Second, different frac pump engines require different fuel pressures to operate, and keeping over a dozen pieces of equipment operating at different pressures is difficult. Third, the space at a fracturing site is limited and conventional systems require multiple hoses snaked in and around the pumps and various trailers. Thus, there exists significant room for improvement in the art for overcoming these and other shortcomings of conventional systems and methods for automatically fueling hydraulic fracturing equipment.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

FIG. 9 is hereby amended to reflect this change in numbering.

Figure 1:
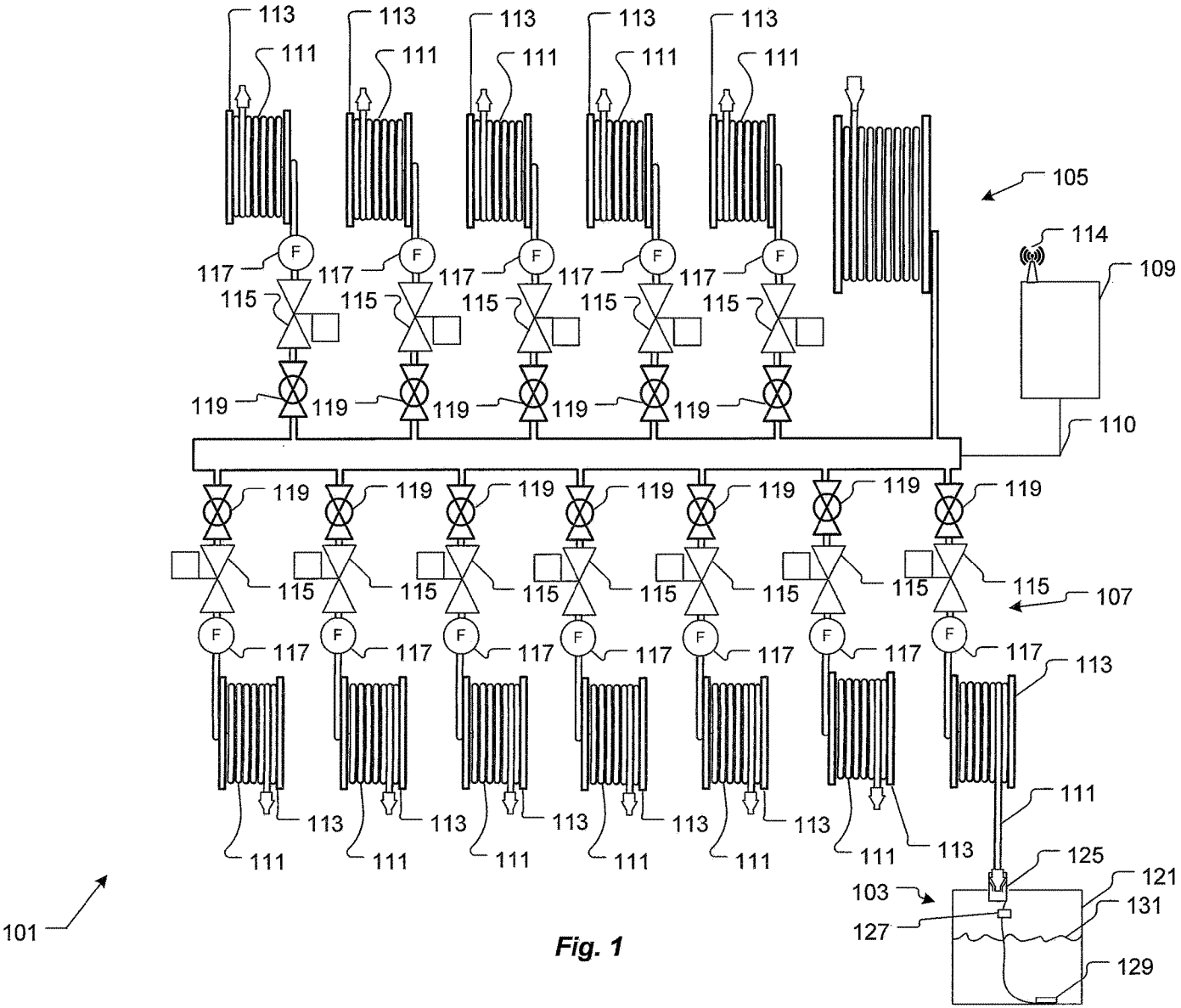
FIG. 1 is a diagram of a system for automatically fueling hydraulic fracturing equipment with the ability to report fuel tank status, usage, and fill level according to the present application.
Figure 2:
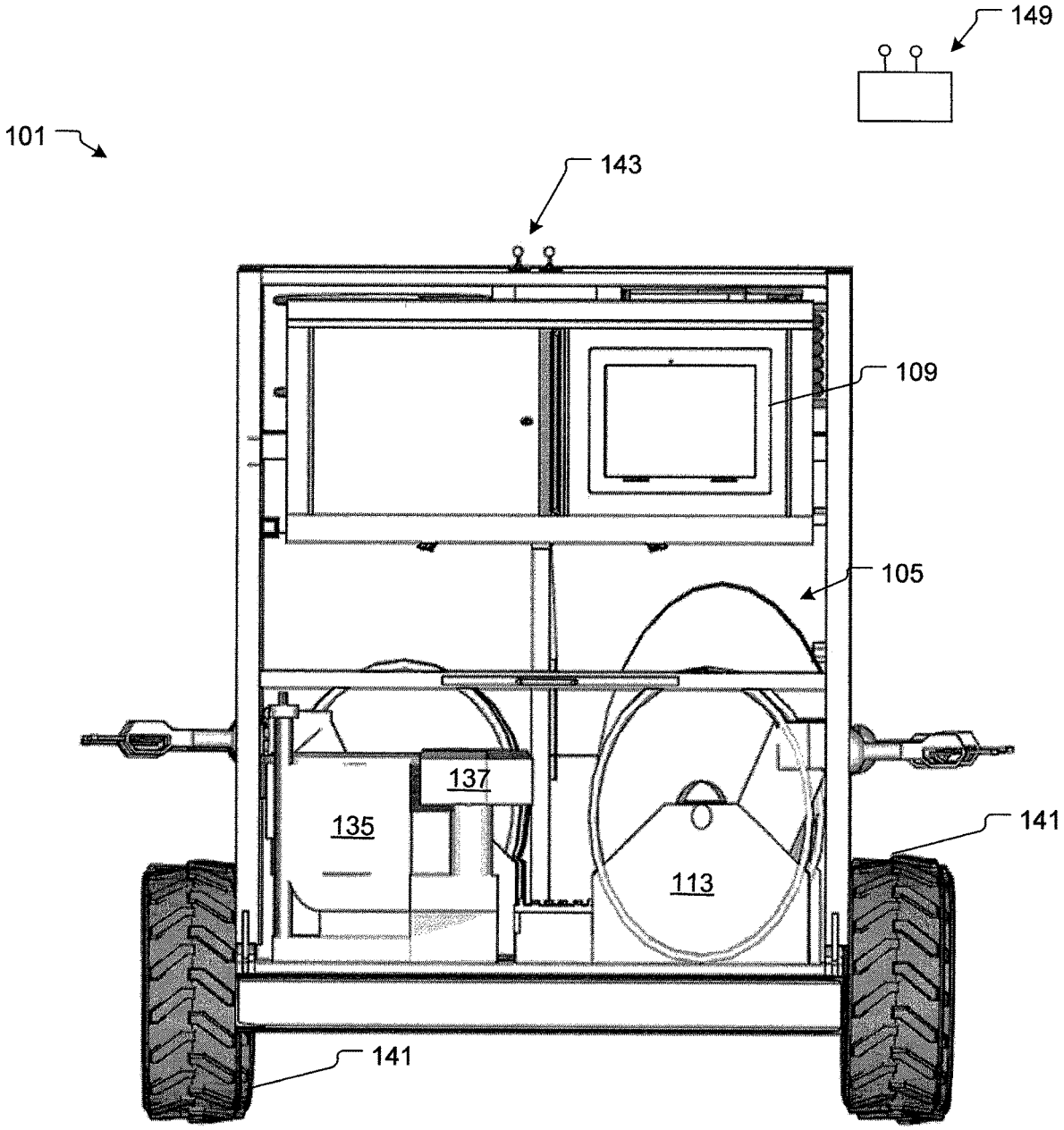
FIG. 2 is an end view of a system for automatically fueling hydraulic fracturing equipment with the ability to report fuel tank status, usage, and fill level according to the present application.
Figure 3:
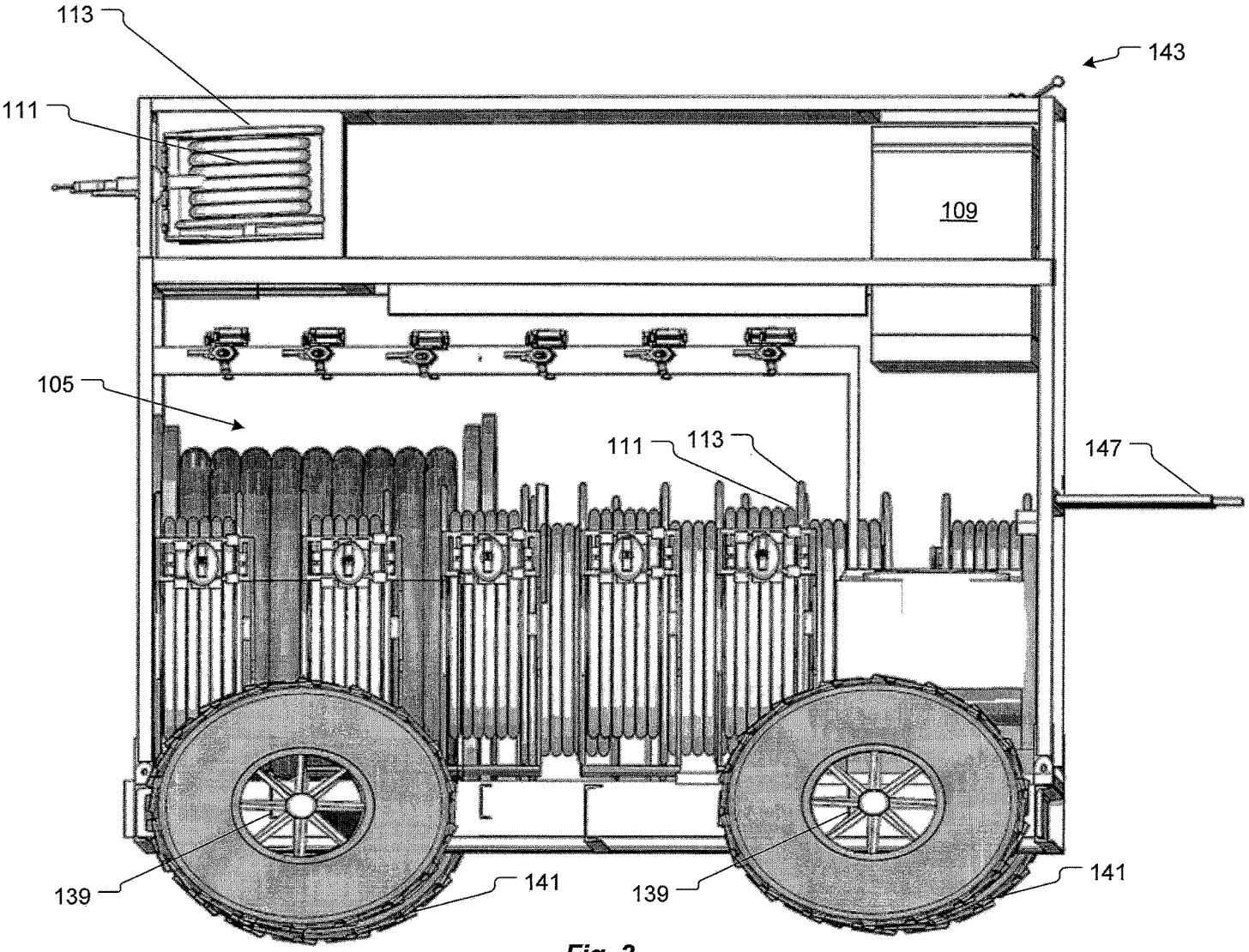
FIG. 3 is a side view of a system for automatically fueling hydraulic fracturing equipment with the ability to report fuel tank status, usage, and fill level according to the present application.
Figure 4:
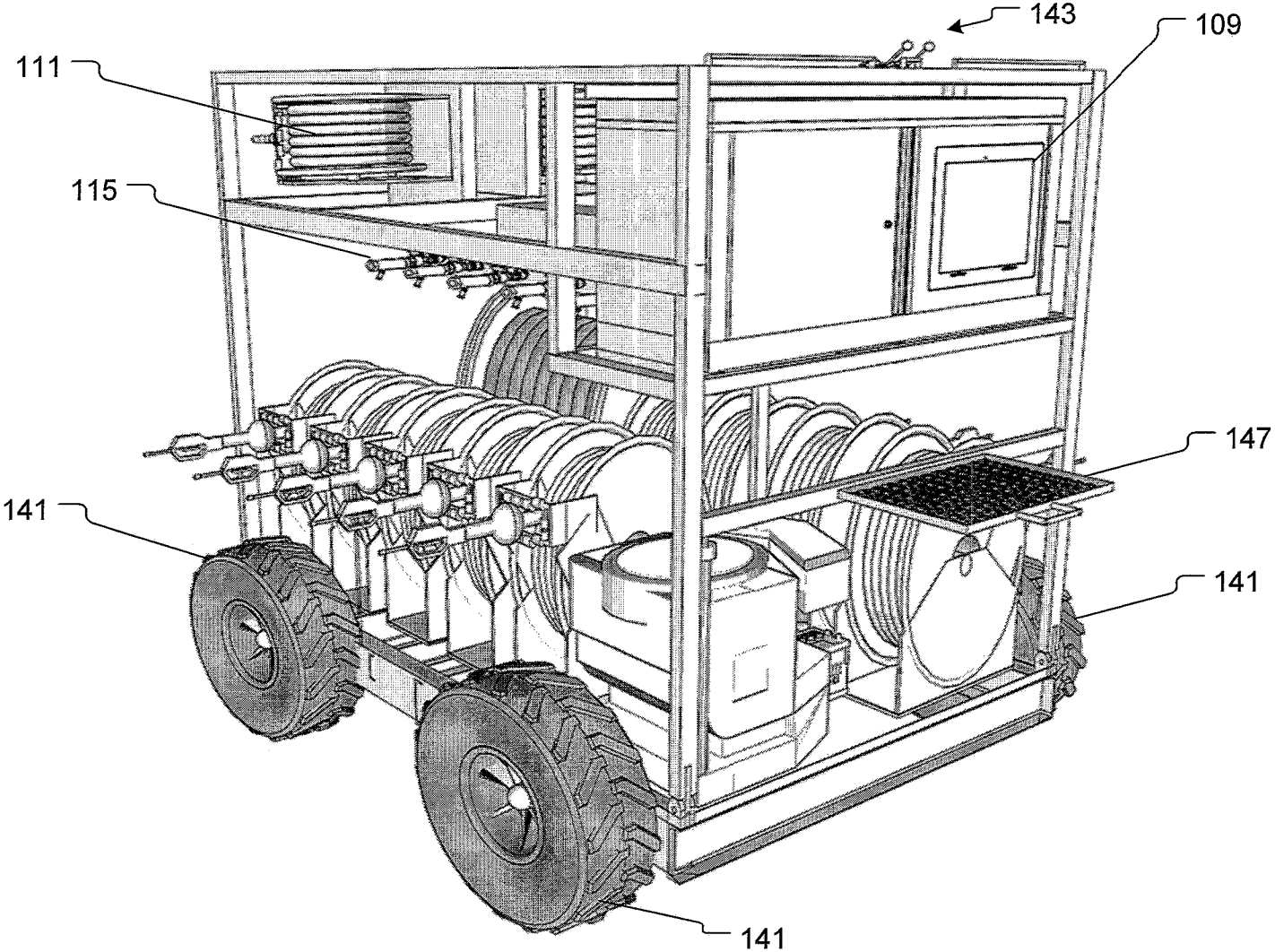
FIG. 4 is a generally downward perspective view of a system for automatically fueling hydraulic fracturing equipment with the ability to report fuel tank status, usage, and fill level according to the present application.
Figure 5:
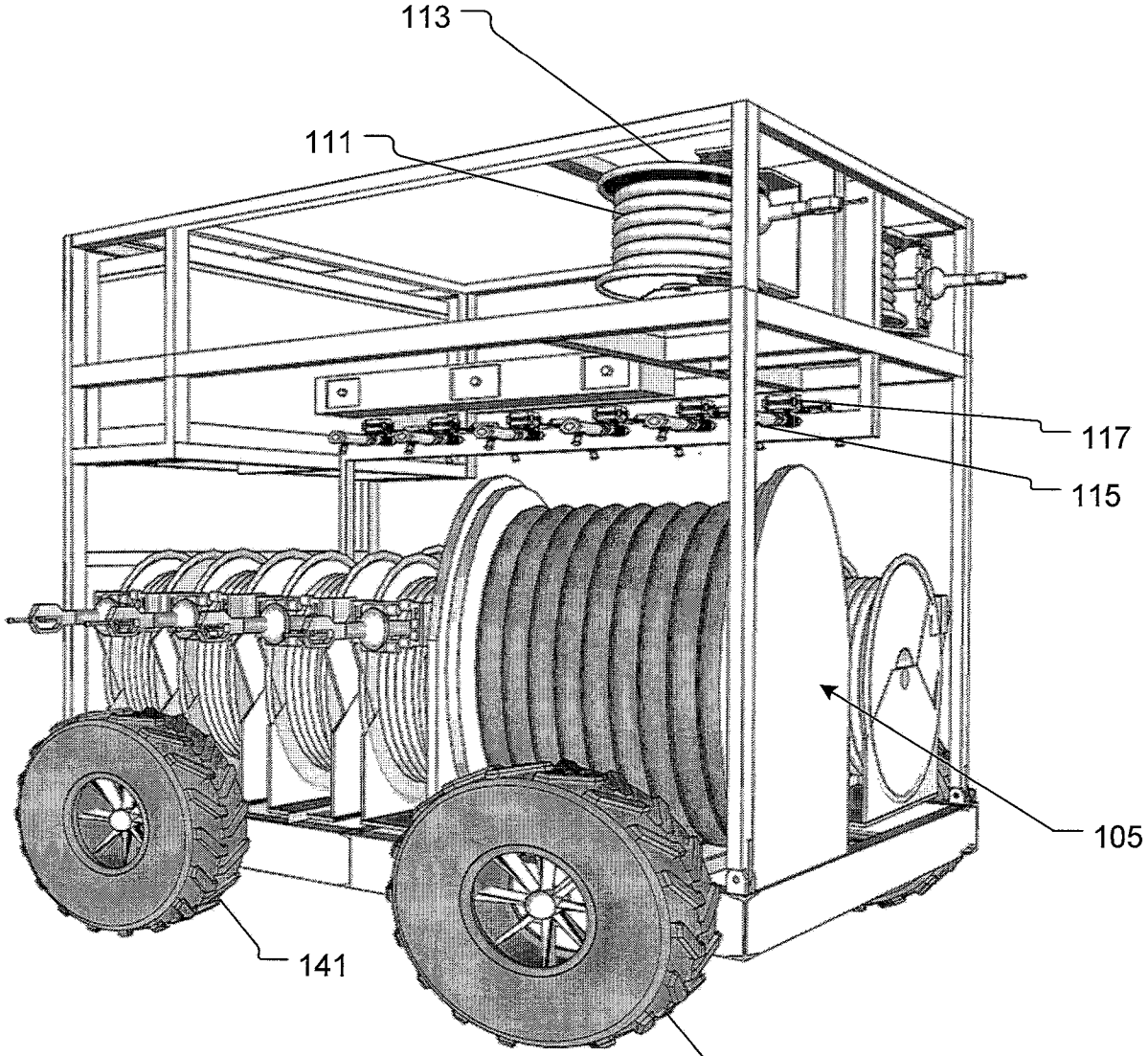
FIG. 5 is a generally upward perspective view of a system for automatically fueling hydraulic fracturing equipment with the ability to report fuel tank status, usage, and fill level according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method for automatic fueling of hydraulic fracturing equipment with the ability to report fuel tank status, usage, and fill level are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Automatic frac pump and frac equipment fueling provides fuel to saddle tanks of hydraulic fracturing equipment as needed by the saddle tanks. The system for automatically fueling hydraulic fracturing equipment is comprised of a fuel input system, a fuel output system, and a control system for regulating the flow of fuel from the input system to the output system. Preferably the system is compact to reduce the footprint at fracturing sites. This system comes with the ability to report fuel tank status, usage, and fill level to users at the fracturing site and remote to the fracturing site, for example at the headquarters of the exploration company.

Referring now to FIGS. 1-5 in the drawings, a preferred embodiment of mobile fueling platform for automatically providing fuel to a saddle tank of the frac equipment according to the present application is illustrated. System 101 is comprised of a fuel cap system 103, a fuel input system 105, a plurality of fuel output systems 107, and a control system 109. Fuel input system 105 is preferably comprised of an input fuel hose located on a hydraulically driven reel and is automatically retractable. As the user pulls the hose from the reel a spring is biased to provide the force to retract the input hose when needed. Alternatively, fuel input system 105 is comprised of a manifold on the platform wherein a fuel line is coupled to manifold. Fuel output system 107 is comprised of fuel hose 111, a reel 113, a remote actuated valve 115, a flow meter 117, and a ball valve 119. Reel 113 is retractable like reel from the input fuel system but is manually driven and is configured to contain the fuel hose when the system does not require a long fuel hose and for when the system is unused. Adjacent the fuel hose 111 is electrical wiring from electrical conduit 110 connecting the control system 109 to the fuel cap system 103 located on the saddle tank 121. To facilitate the clarity of the illustrations the hosing between the reels 113 and the remote actuated valves 115 has been removed, however it should be apparent that the valves 115 are coupled to the reels 113. The preferred embodiment of the reel 113 is a manual reel however due to the weight of some fuel lines a hydraulically driven reel is contemplated by this application. Flow meter 117 is configured to allow the system to report the fill status of the corresponding tank and the fuel tank usage over a stage level, a daily level, and a job level.

Fuel cap system 103 is comprised of a fuel cap 125 with a male fluid coupling, a high sensor 127, and a low sensor 129. Male fluid coupling is configured to quickly allow the fuel hose 111 connect to the fuel cap system. Each saddle tank will utilize the fuel cap system 103. The high sensor 127 of the fuel cap system is configured to measure the amount of fuel in the saddle tank near the rated capacity of the tank. The low sensor 129 of the fuel cap system is configured to measure the entire amount of fuel in the saddle tank. The high sensor is preferably an ultrasonic sensor suspended above an upper surface 131 of the fuel within saddle tank 121 and alerts the system once the fluid level in the tank is high enough to break an ultrasonic beam. The low sensor is preferably a pressure sensor and is submerged into the fluid. As the tank is filled the pressure increases. The high sensor is a redundant sensor to insure that the valve is closed when the fuel level in the tank approaches the tank's capacity. Low sensor 129 provides data to the system in order for the tank fill level to be reported.

System 101 further comprises a propulsion system having a combustion motor 135, a hydraulic system 137, a plurality of hydraulic motors 139 coupled to the wheels 141 of the system, and a steering system 143. Steering system 143 is preferably a set of hydraulic valves connecting the hydraulic system 137 to the plurality of hydraulic motors 139. A user stands on foldable bracket 147 and can steer and move the system by moving the steering system. Foldable bracket 147 is configured that the user is able to see over a top of the system to drive it. The propulsion system is preferably both 2 wheel drive and four wheel drive capable by toggling a valve. Since wells sites are typically muddy having a four wheel drive capable system facilitates moving the cart/platform near the hydraulic fracturing equipment. Furthermore, the unit can be moved by a remote control 149 that operates the hydraulic valves in control of the hydraulic motors 139. With the remote control 149 the user can drive the unit around the job site and steer clear of obstacles in the confined spaces around a fracturing site.

Control system 109 is preferably a programmable logic controller with a display and assesses the amount of fuel to dispense based upon the low sensor 129. Control system 109 can be calibrated by entering in the distance from a bottom of the saddle tank to the max fill line to determine the relative expected pressures when the tank is near the max fill line. Alternatively in addition to the low sensor an ultrasonic distance sensor measures the amount of fuel in the saddle tank by ultrasonically measuring a distance between the ultrasonic distance sensor and the upper surface of the volume of fuel in the saddle tank. High sensor acts as a redundant stop where the valve 115 is closed whenever the top of the fuel is close to the high sensor. High sensor prevents fuel spills when the low sensor fails. Control system 109 is electrically coupled to the high sensor and the low sensor by wiring located adjacent the hose 111. Both the hose 111 and the wiring to the high and low sensor are contained in a common conduit. In the preferred embodiment, the reel 113 is continually coupled between the valve and the hose 111 while the electrical wiring has a disconnect. Alternatively, both the fuel line and the wiring to the high and low sensors have sliprings in the reel and are continually coupled. Control system 109 is also wired to flow meter 117. Control system 109 tracks fuel flow to each tank by the amount of fuel flowing through the flow meter 117. This flow data provides users with feedback regarding how efficient the hydraulic fracturing equipment are operating. Furthermore, the control system provides manual control of the valve 115 by a series of switches for each reel. This allows a user to either prevent the remote activation, engage the remote valve, or allow the system to control the valve. Control system may further comprise an indicator tower and an emergency stop both located on the cart. While the preferred embodiment of the system uses wiring to connect the control system 109 to the sensors and valves, alternatively the control system is wirelessly connected to the sensors of the fuel cap system and the valves using wireless antenna 114.

Typically the system 101 is comprised of twelve fuel output systems 107 connected to a single fuel input system 105. This configuration allows for a single platform to fuel a dozen saddle tanks concurrently. Typically the fuel line of the fuel output system is ½" or ¾" diameter and the diameter of the fuel input system is 2" diameter. In the preferred embodiment the control system is powered remotely, alternatively the system further comprises a generator or solar system to supply voltage to the control system.

Figure 6:
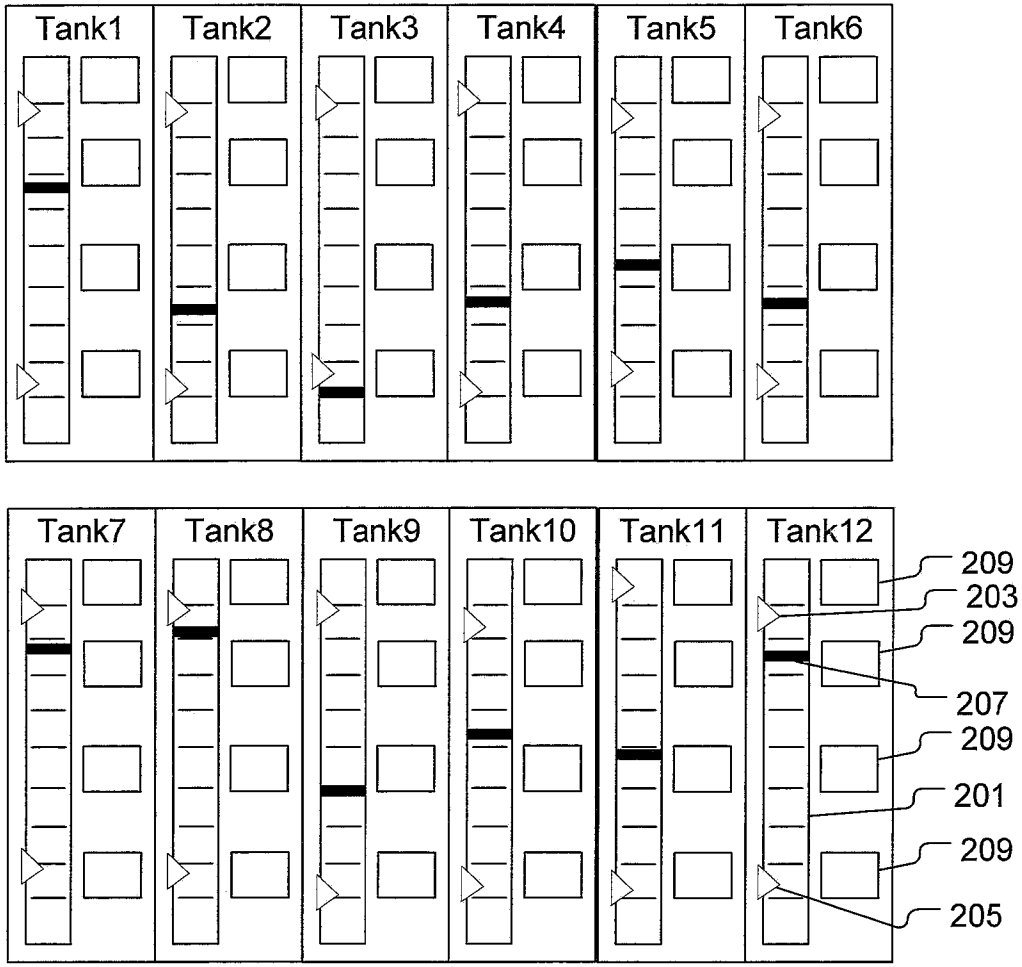
FIG. 6 is a diagram of a controller screen from a system for automatically fueling hydraulic fracturing equipment with the ability to report fuel tank status, usage, and fill level according to the present application.

Referring now also to FIG. 6 in the drawings, a preferred embodiment of display screen for automatically providing fuel to saddle tanks of hydraulic fracturing equipment according to the present application is illustrated. Control system 109 displays conditional information to a screen mounted to the platform. This allows users to glance at the platform and assess the condition of the system. Each tank is represented by a bar chart 201 scaled to the saddle tank capacity. High mark 203 displays the stop filling position of the system associated with tank 12. Once the fuel level is at the high mark the valve 115 closes to stop fuel flow into the saddle tank. Low mark 205 displays the start filling position of the system associated with tank 12. Once the fuel level is below the low mark the valve 115 opens and fuel flows into the saddle tank. Tank level 207 displays the relative position of the fuel level scaled. As an example, Tank 3 requires additional fuel to be added to the saddle tank because the fuel level is below the low mark as set by the user. Additionally indicators 209 display information such as pressure, flow, quantity, and valve position to the user. Each tank is separately controlled and monitored to allow users to customize the system based on the type of frac equipment, the type of saddle tank, the user's preferences, frac equipment issues or problems.

Figure 7:
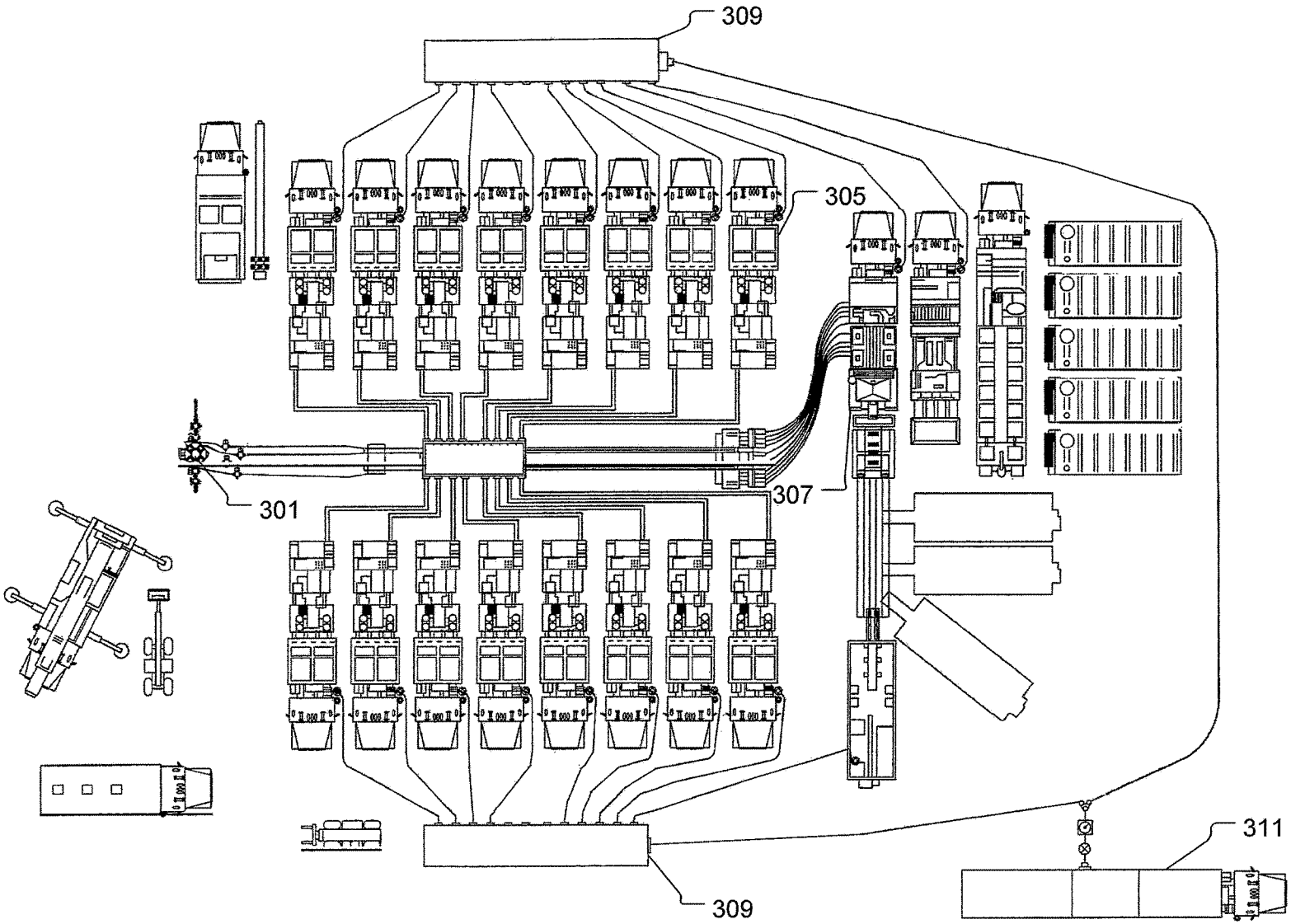
FIG. 7 is a well site diagram of a system for automatically fueling hydraulic fracturing equipment with the ability to report fuel tank status, usage, and fill level according to the present application.
Figure 8:
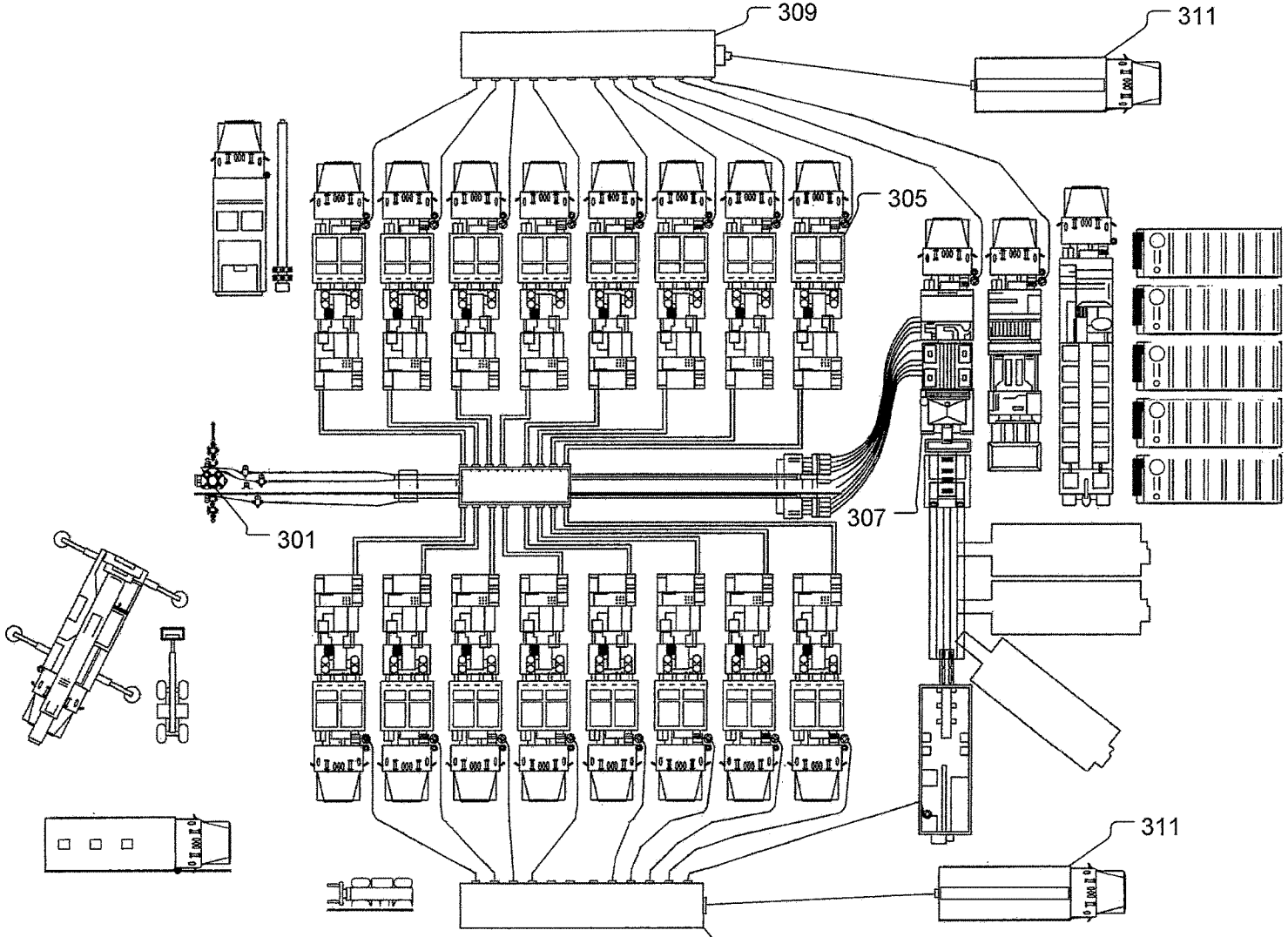
FIG. 8 is a well site diagram of a system for automatically fueling hydraulic fracturing equipment with the ability to report fuel tank status, usage, and fill level according to the present application.

Referring now also to FIGS. 7 and 8 in the drawings, embodiments of mobile cart layouts for automatically providing fuel to saddle tanks of hydraulic fracturing equipment according to the present application are illustrated. A frac site for oil and gas wells are a congested place during the time of fracturing the well. A well head 301 is connected to a plurality of frac pumps 305 and blender/chemical trailers 307. To operate the various pumps and trailers require refueling of their diesel tanks. A mobile fueling platform 309 is located near the frac pumps 305. Preferably the platform is moved into position by driving it into position as described above however the platform can be pulled or forked into position.

A fuel cap system is installed into each saddle fuel tank. A hose is extended from each reel as needed and coupled to the fuel cap system. Additionally a hose is extended from the cart to the supply tank 311. Calibration of the sensors as needed is performed. The user then allows the controller to control the remote controlled valve by flipping a switch or depressing a button. The system then autonomously fills the saddle tanks from the supply tank 311. A sale meter is located between the supply tank and the cart to document the volume of fuel sold. Once the frac job is complete the process is reversed. The extended hoses are decoupled and retracted into the cart. The fuel caps are removed from the saddle tanks.

While the system as illustrated in FIG. 7 is shown with two carts or platforms 309 and one supply tank 311. An alternative embodiment combines the two platforms and the supply tank into a single trailer for providing automatic fueling to an entire well site. Additionally as shown in FIG. 8 the system can be comprised of two carts or platforms 309 and two supply tanks 311.

Figure 9:
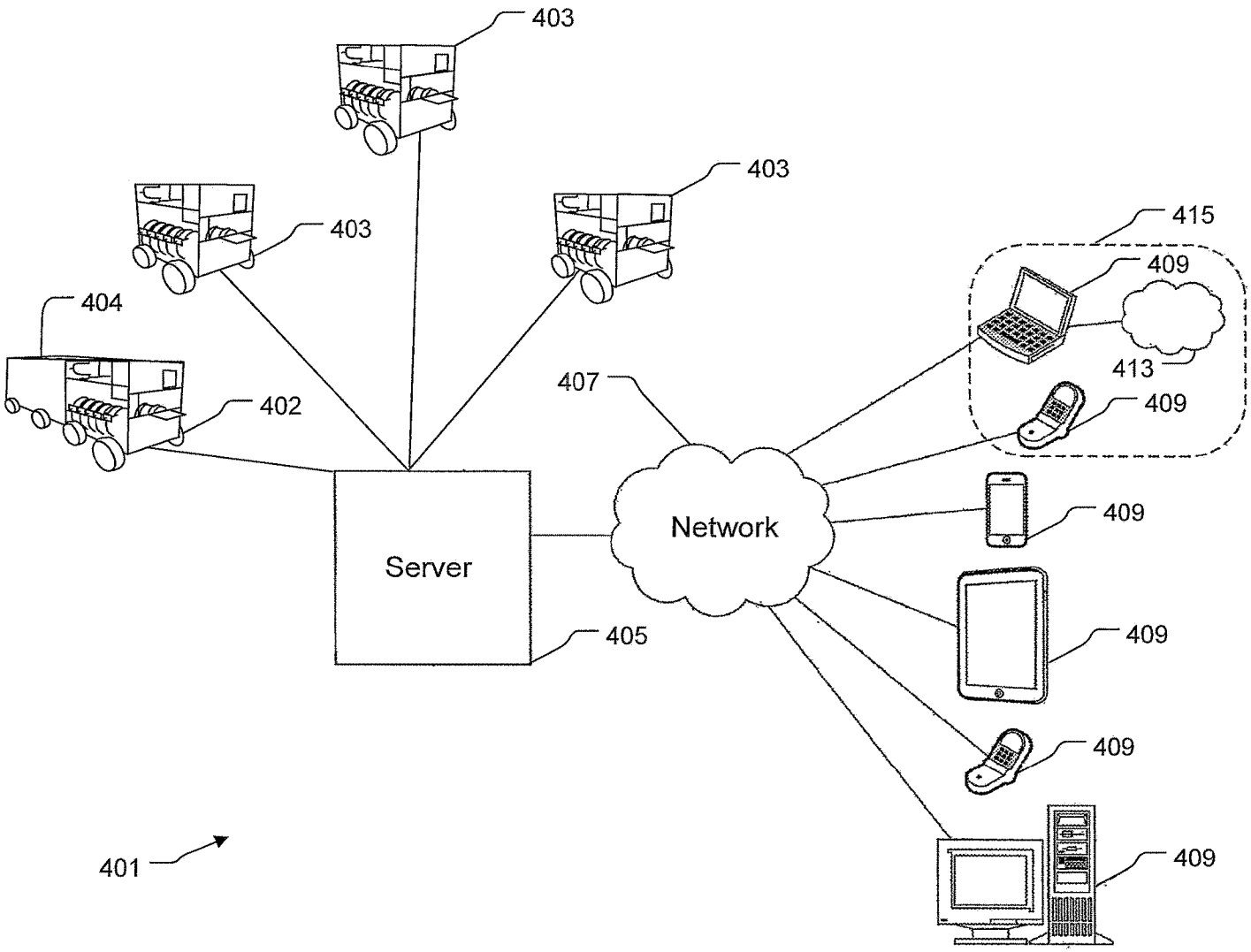
FIG. 9 in the drawings is hereby amended in order to correct a clerical error and is submitted herewith. The Specification is hereby amended to recite a mobile fueling platform 402 having an onboard fuel supply tank 404.

Referring now also to FIG. 9 in the drawings, an embodiments of a mobile cart system for automatically providing fuel to saddle tanks of frac pumps with real time fuel reporting according to the present application is illustrated. Reporting system 401 is comprised of a plurality of carts 403, a mobile fueling platform 402 having an onboard fuel supply tank 404, server 405, a cloud interface 407, and a plurality of connected reporting devices 409. Some connected reporting devices 409, having a unique interface 413, are combined into an enterprise system 415. The plurality of connected reporting devices 409 is comprised of laptops, cellular phones, smartphones, tablets, desktop computers. Enterprise system 415 is configured for providing specialized information for an end user. For example, a first enterprise system can be configured for an operating company and a second enterprise system can be configured for a drilling company. Each enterprise system utilizes a different user interface to provide specific information required by the enterprise. The carts 403 are connected to the server 405 such that data from the sensors of each cart is transmitted to the server. The connection is preferably wireless, however wired connections are contemplated by this application. Furthermore, the plurality of connected reporting devices are connected to the server 405 by a cloud network 407. Thereby a user can remotely track and monitor fuel status from several frac sites from a single place or check the other frac sites from a first frac site.

The reporting system takes the data from the sensors and provides real time tracking of fuel usage from the embedded sensors. The reporting system is also able to provide users with time histories of fuel usage such as: an amount of fuel usage over a stage of a frac; an amount of fuel usage over a day; an amount of fuel usage over a job; and an amount of fuel in the saddle tank. Additionally the reporting system can provide the amount of fuel in each of the saddle tanks and the supply tanks.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A mobile fueling platform for filling a saddle tank and reporting the saddle tank usage, comprising:

a propulsion system for independent movement;

a steering system for independent steering;

wheels connected to the steering system;

a foldable bracket configured for a user to stand on while controlling at least one of the steering system and the propulsion system;

wherein the foldable bracket is coupled to the mobile fueling platform above the wheels to allow the user to see over a top of the mobile fueling platform while standing on the foldable bracket;

a single fuel input system, comprising:

a hydraulically driven reel; and an input fuel hose disposed on the hydraulically driven reel;

wherein the input fuel hose is automatically retractable;

a plurality of fuel output systems, each fuel output system, having;

an output fuel hose;

a reel configured for storing the output fuel hose; and an electrically actuated valve coupling the single fuel input system to the plurality of fuel output systems;

wherein the electrically actuated valve is a remote actuated valve;

a controller electrically connected to the electrically actuated valve;

a remote control configured for controlling at least one of a hydraulic system and the remote actuated valve;

a low sensor located in the saddle tank adjacent a bottom surface of the saddle tank;

a high sensor located in the saddle tank; and a display to present an amount of fuel based on at least one of the low sensor and the high sensor;

wherein the saddle tank is connected to at least one fuel output system of the plurality of fuel output systems;

wherein the controller controls fuel flow through each fuel output system of the plurality of fuel output systems based upon continuous measurements from both the low sensor and the high sensor;

wherein the high sensor is suspended inside the saddle tank above an upper surface of a volume of fuel inside the saddle tank;

wherein the low sensor is submerged within the volume of fuel inside the saddle tank;

wherein the low sensor is a pressure sensor and the high sensor is an ultrasonic distance sensor; and wherein the controller regulates fuel flow by actuation of the electrically actuated valve.

2. The mobile fueling platform according to claim 1, further comprising:

a flow meter located between the single fuel input system and the plurality of fuel output systems.

3. The mobile fueling platform according to claim 1, further comprising:

an onboard fuel supply tank.

4. The mobile fueling platform according to claim 1, further comprising:

a reporting system communicatively coupled to the display;

wherein the reporting system is configured to report to the user a status of the saddle tank.

5. The mobile fueling platform according to claim 4, the status of the saddle tank comprising:

an amount of fuel usage over a stage;

an amount of fuel usage over a day;

an amount of fuel usage over a job; and an amount of fuel in the saddle tank.

6. The mobile fueling platform according to claim 1, further comprising:

a ball valve located between the single fuel input system and the plurality of fuel output systems.

7. A system for automatically fueling saddle tanks of hydraulic fracturing equipment, comprising:

a server communicatively coupled to a network by way of a cloud interface;

a connected reporting device communicatively coupled to the network by way of the cloud interface;

a cart communicatively coupled to the server, comprising;

a single fuel input system, having;

an input fuel hose; and an input reel;

a plurality of fuel output systems, each having;

an output fuel hose;

an output reel; and a remotely actuated valve; and a propulsion system for independent movement;

a steering system for independent steering;

a foldable bracket configured for a user to stand on while controlling at least one of the steering system and the propulsion system;

wheels connected to the steering system;

wherein the foldable bracket is coupled to the cart above the wheels to allow the user to see over a top of the cart while standing on the foldable bracket;

a controller electrically connected to the each of the remotely actuated valves; and a display configured to display an amount of fuel based on at least one of the fuel input system and a fuel output system;

wherein the controller regulates fuel flow by actuation of each of the valves; and a plurality of fuel cap systems, each having;

a fuel cap;

a low sensor configured to provide the controller with a first indication of a fuel level within a saddle tank, the low sensor carried by the fuel cap, the low sensor being a pressure sensor submerged within a volume of fuel inside the saddle tank; and a high sensor configured to provide the controller with a second indication of the fuel level within the saddle tank, the high sensor carried by the fuel cap, the high sensor being an ultrasonic distance sensor suspended above an upper surface of the volume of fuel inside the saddle tank;

wherein the first indication and the second indication of fuel level are continuously provided to the controller.

8. The system according to claim 7, the plurality of fuel output systems further comprising:

a plurality of saddle tanks;

a flowmeter located in each of the fuel output systems and communicatively coupled to at least one of a reporting system and the display;

wherein each of the flowmeters is configured to track and report at least one of a stage fuel usage level and a daily fuel usage level of a respective tank of the plurality of saddle tanks.

9. The system according to claim 7, the plurality of fuel output systems further comprising:

a ball valve located between the fuel input system and each of the plurality of fuel output systems.

10. The system according to claim 7, wherein the low sensor and the high sensor are wirelessly connected to the controller.

11. The system according to claim 7, wherein the cart is configured for four wheel drive.

* * * * *